United States Patent [19]

Suarez

[11] 4,043,553

[45] Aug. 23, 1977

[54] ECCENTRIC ROTATABLE WEIGHT EXERCISING DEVICE

[75] Inventor: Richard A. Suarez, Canton, Ohio

[73] Assignee: Consumer Publishing Company, Inc., Canton, Ohio

[21] Appl. No.: 651,940

[22] Filed: Jan. 23, 1976

[51] Int. Cl.[2] ..... A63B 21/00

[52] U.S. Cl. ..... 272/128; 272/DIG. 5; 272/123

[58] Field of Search ..... 272/122, 123, 124, 117, 272/118, 128

[56] References Cited

U.S. PATENT DOCUMENTS

| | | | |
|---|---|---|---|
| 460,270 | 9/1891 | Somerby | 272/122 |
| 825,955 | 7/1906 | Bohache | 272/124 |
| 3,468,534 | 9/1969 | Donato | 272/123 |
| 3,756,597 | 9/1973 | Monti | 272/123 |
| 3,904,198 | 9/1975 | Jones | 272/123 |

*Primary Examiner*—Richard C. Pinkham
*Assistant Examiner*—William R. Browne
*Attorney, Agent, or Firm*—Meyer, Tilberry & Body

[57] ABSTRACT

An exercise device for improving muscular tone, primarily of the upper torso and arms, is provided wherein circular motion is imparted to a pair of hand grips rotatably secured to an eccentrically weighted cross shaft. Sufficient tolerance is provided between the cross shaft and the hand grips so that the cross shaft is free to move in an orbital path eccentric to the center of said hand grips, wherein the orbital movement of said hand grips and the eccentric orbital movement of said cross shaft may be utilized to exercise various muscles of the body.

11 Claims, 7 Drawing Figures

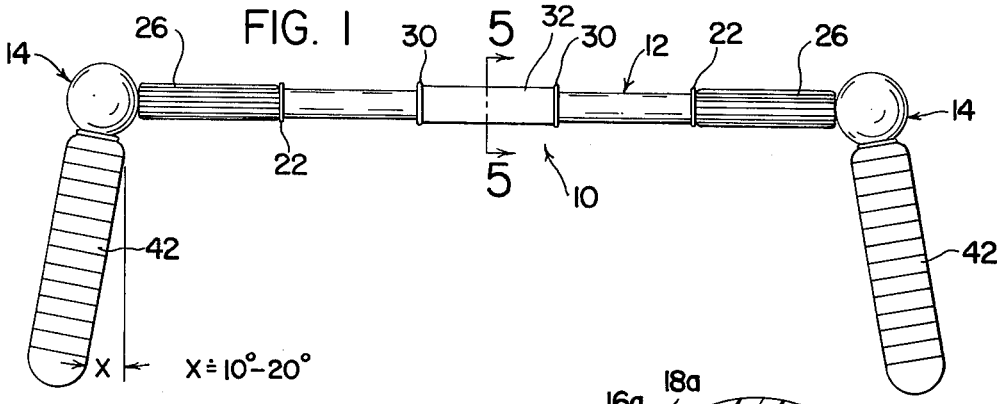
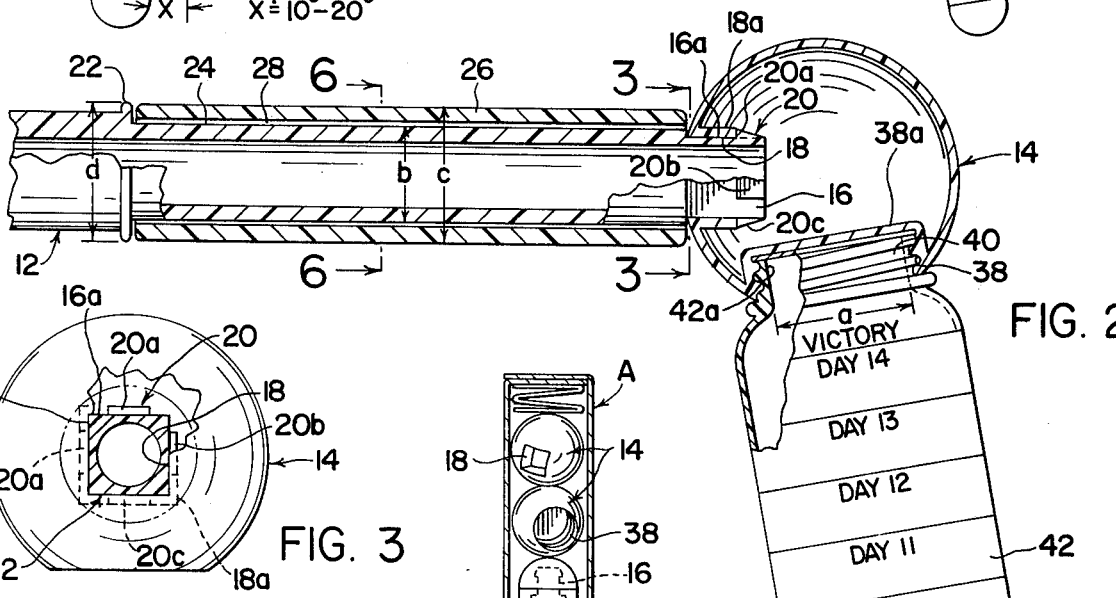
FIG. 2
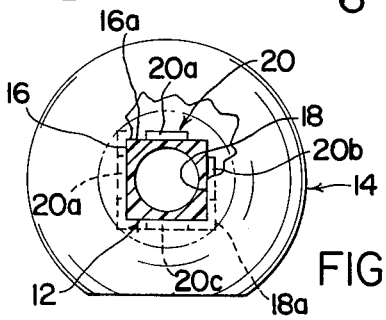
FIG. 3
FIG. 4
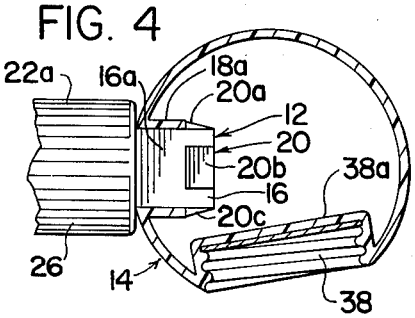
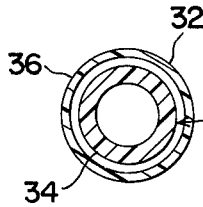
FIG. 5
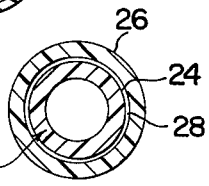
FIG. 6
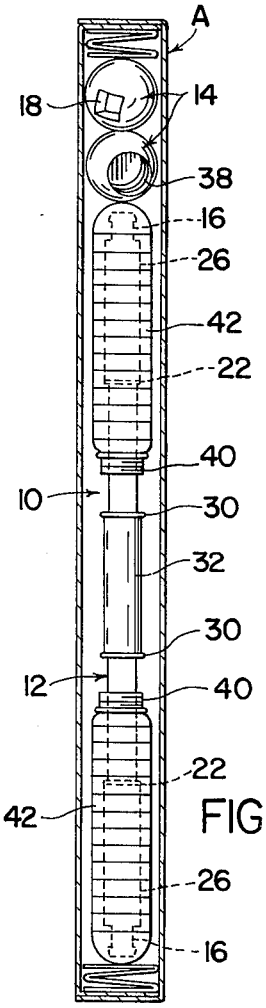
FIG. 7

ECCENTRIC ROTATABLE WEIGHT EXERCISING DEVICE

This invention relates to a physical therapy device adapted to exercise the muscles of the body and, in particular, the muscles of the upper torso of the body and of the arms and wrists. The invention is considered to be an improvement over the prior art of which the patents to Donato, U.S. Pat. No. 3,468,534 and to Monti U.S. Pat. No. 3,756,597 are examples. This invention operates generally in accordance with the eccentric rotatable weight concept of the above noted prior art devices but is an improvement thereover in several respects, particularly with respect to the protection of the excerciser during use against inadvertent, accidental, or improper application of the device, prevention of inadvertent disassembly and improvement in the convenience of packaging.

In recent years, there has been a substantial demand for exercise devices which are inexpensive, easy to operate and require little storage space. One of the more popular types of device in this category is the eccentric rotatable weight device as illustrated in U.S. Pat. Nos. 3,468,534 and 3,756,597. However, these two devices, although having practical operation, have certain difficulties. For instance, in the device of U.S. Pat. No. 3,468,534 the configuration of the support frame requires a large, specially constructed package. In addition, the weights must be shipped with the device, resulting in increased shipping costs. These disadvantages seriously affect the cost of the exercise device. Since the weight supporting arms are between the gripping portions of the frame, they tend to hit the user and can cause some painful bruises and dermal discoloration.

The device illustrated in U.S. Pat. No. 3,756,597 solves some problems of the device discussed above; however, other problems are introduced. By making the eccentric rotatable weight exercising device from only a tubular member, it can be more conveniently packaged. Also, the use of fillable weights reduces the shipment weight and cost. However, this exercise device uses rotatable arms fastened to the cross frame. It has been found that the joints of these arms are unintentionally disconnected during use. Also, the rotating arms substantially increase the operating difficulty and decrease the effectiveness of the device.

All of these disadvantages of prior eccentric rotatable weight exercising devices are overcome by the present invention wherein the eccentric weights are fixed with respect to the cross-frame and are formed as pliable elongated receptacles which can be filled with varying amounts of liquid. In addition, the receptacles are connected to the cross-frame with coupling elements which are easy to assemble and to disassemble to allow the hollow weight receptacles to be telescoped over the ends of the frame for shipment in a somewhat standard elongated carton.

In accordance with the present invention, there is provided an exercise device including an elongated frame having two spaced ends and at least one generally cylindrical gripping portion between said ends. An elongated, generally tubular hand grip is journalled around the gripping portion whereby the frame may rotate within the hand grip and an eccentric weighting means for said frame is located adjacent each spaced end. Each of the weighting means comprises an intermediate coupling element having a first coupling means for fixedly and non-rotatably coupling the element to the frame at one of the spaced ends with the frame extending along a first direction from said coupling element and a second coupling means for coupling an elongated weight member onto the element with the elongated weight member extending along a second direction from said coupling element, wherein the included angle between the first and second directions is greater than 90°.

It is an object of this invention to provide an exercising device which may be used with considerably more safety than devices presently known in the prior art; it is a further object of this invention to provide a device for providing exercise of muscles of the body more efficiently than prior art devices; it is another object of this invention to provide an exercise device which may be readily adapted for use in different manners to provide different muscular exercises.

A further object of the invention is the provision of an exercise device of the eccentric rotatable weight type, which device is easy to assemble, is easy to pack in a somewhat standard carton and is assembled from a few component parts.

Other objects and a further understanding of the invention may be had by referring to the following description and claims, taken into conjunction with the accompanying drawings in which:

FIG. 1 is an elevational view of the improved exercising device;

FIG. 2 is an enlarged, partial view showing one end of the device illustrated in FIG. 1;

FIG. 3 is a cross-sectional view taken generally along lines 3—3 of FIG. 2;

FIG. 4 is a partial view showing the coupling element used in the preferred embodiment of the present invention;

FIG. 5 is an enlarged cross-sectional view taken generally along lines 5—5 of FIG. 1;

FIG. 6 is a cross-sectional view taken generally along lines 6—6 of FIG. 2; and, FIG. 7 is a side elevational view showing the preferred embodiment disassembled and packaged for shipment.

Referring now to the figures in greater detail, and in particular to FIGS. 1 and 2, the exercise device 10 is comprised of a cross shaft 12 to which a pair of connector members or coupling members 14 are non-rotatably secured to the opposite spaced ends 16 of cross shaft 12. Cross shaft 12 is circular in cross-section, as shown in FIGS. 5 and 6, and the ends 16 are provided with square shanks 16*a* fitting within square apertures or bore 18 in a generally square boss 18*a* of connector or coupling members 14. The fastener means 20 secures the connector or coupling member 14 against removal of ends 16 of cross shaft 12 from boss 18*a* after assembly. This fastener means may take various forms; however, in the illustrated embodiment, it is four snap lips 20*a*, 20*b*, 20*c* and 20*d*.

Ribs 22 are provided on cross shaft 12 to locate a pair of axially spaced cylindrical gripping portions 24 around which hand grips 26 are journalled on cross shaft 12 between ribs 22 and connector member 14. As best shown in FIGS. 5 and 6, the outside diameter *b* of cross shaft 12 at gripping portion 24 is considerably less than the inside diameter of hand grip 26 to provide a space therebetween shown at 28. A second pair of ribs 30 is provided to locate a third hand grip 32, which grip is located intermediate ends 16 of the cross shaft 12. The interior diameter of hand grip 32 is greater than the exterior diameter of cross shaft portion 34 of cross shaft 12 to provide a space 36 therebetween. Hand grips 26 are provided for two hand exercises, and hand grip 32 permits one hand exercises. The spaces 28, 36 provide free movement of shaft 12.

Connector members 14 have female threaded openings 38 to receive the male threaded mouth 40 of an elongated weight in the form of a receptacle. Mouth 40 of weight 42 includes an opening 42*a*. The location of female threaded opening 38 is selected to align weight members 42 to form an obtuse angle with the longitudinal axis of cross shaft member 12, as shown in FIGS. 1 and 2. This obtuse angle is 90° plus the angle *x* shown in FIG. 1. In practice, best results are obtained by an angle *x* of between about 10°–20° to provide an obtuse angle of about 100°–110°.

Elongated weight member 42 is a hollow receptacle and, except for the mouth portion 40, is otherwise sealed to contain varying amounts of fluid type weighting substances such as water, sand, or shot. Wall 38*a* closes receptacle 42 when it is assembled onto connector member 14. The exterior of elongated weight member or receptacle 42 is provided with graduations for measuring additions of weighting matter. The weight member may be semitransparent in order to assist in adding measured amounts of weighing matter into the weight member. Connector members 14 and elongated weight members or receptacles 42 are made of soft, deformable plastic so as to protect the exerciser in case the device should strike a portion of the exerciser's body due to inadvertent, accidental or improper usage of the device. In like manner, in the preferred embodiment, the cross shaft 12 is made of flexible plastic sufficiently rigid to support the weight members or receptable 42, but sufficiently yieldable that impact upon the exerciser's body will provide some yielding in the cross shaft 12 with less harmful consequences to the exerciser than if the cross shaft were metal and/or rigid plastic.

The hand grips 26 are spaced apart one from the other in order to maintain the exerciser's arms parallel during use of device 10. With this spacing of the arms, and the obtuse angulation of the weight members 42, during rotation of the weight members 42 with cross shaft 12 the weight members 42 will be free and clear of the exerciser's body and thus the possibility of accidental impact between the exerciser and one of the weight members 42 is rendered minimal. For beginners or persons weakened due to muscular atrophy or muscular disease, the weights 42 may be removed entirely for initial exercises. For advanced exercises, or for exercises with which to practice particular muscle therapy, the center hand grip 32 is provided wherein the device may be utilized with only one hand.

In operation, because of the tolerance between the cross shaft member portions 23 and 34, and hand grips 26 and 32 respectively, provided by spaces 28 and 36 respectively, a circular motion of the hand grips 26 in parallel vertical planes will induce an eccentric orbiting movement of the cross shaft 12 within the hand grips 26. This eccentric orbiting movement provides a compounded force against which the muscles primarily of the arms, chest, and stomach, will react and thereby be toned and stimulated. In like manner, for exercise of one arm only, the device may be moved about a circle in a vertical plane to provide the same compound forces against which the muscles in the one arm will particularly respond.

Accordingly, by providing an entirely plastic exercising device in which all sharp angles and corners have been removed, and replaced with smooth rounded surfaces, a safe exercise device is provided wherein accidental contact between the exerciser and any part thereof will result in but minimal harm, if any, to the exerciser. Additionally, the exercise device is versatile in that it may be used with or without the weight members or receptacles 42 and may be used with two hands or only one hand depending on the objectives of the exerciser. Although this invention has been described with respect to the preferred embodiment as shown in the drawings, it is not intended that the foregoing disclosure of the preferred embodiment of the invention be construed as a limitation.

In accordance with one aspect of the invention, the internal diameter *a* of opening 42*a* is greater than the outside diameter *b* of cylindrical portion 24. Indeed, diameter *a* is also larger than the outside diameter *c* of hand grip 26 and the outside diameter *d* of rib 22. In this manner, for shipment a manufacturer can assemble the elongated weights 42 over the ends of shaft 12, as shown in FIG. 7. This provides a compact assembly which may be shipped in an inexpensive elongated carton A or a mailing tube of standard design. Coupling or connector members 14 are easily placed into the carton for assembly by the recipient. Consequently, by using fillable weights with the disclosed geometry, the cost of packaging and shipment is quite low. This is a major factor in profitable marketing of an exercising device of the type to which this invention is directed.

The connector members 14 are generally spherical in shape and formed from a somewhat rigid plastic; however, other appropriate shapes and material would be possible.

It is understood that numerous changes in the details of construction and the combination and arrangement of parts may be resorted to without departing from the scope of the invention as set forth in the appended claims.

Having thus described my invention, I hereby claim:

1. An exercise device for improving muscle tone comprising: a cross shaft; a pair of hand grips encircling the ends of said cross shaft positioned so as to maintain an exerciser's arms substantially parallel; means to eccentrically weight said cross shaft including a hollow elongated weight of deformable plastic non-rotatably secured to each end of said cross shaft by spherical connector members non-rotatably secured to the ends of said cross shaft and adapted to removably receive the ends of said elongated weights therein, each weight forming an obtuse angle with said cross shaft sufficient to clear the body of the exerciser.

2. The device of claim 1, wherein each end of said cross shaft is provided a protrusion having at least one flat portion; and an opening in said connector member and having a cross sectional profile adapted to receive said protrusion non-rotatably therein.

3. The device of claim 1, wherein each of said connector members is composed of deformable plastic and includes a threaded fastener means for removably securing an end of one of said elongated weights therein.

4. The device of claim 1, wherein said connector members and said elongated weights are soft and deformable plastic.

5. An exercise device for improving muscle tone comprising: a cross shaft; a hand grip encircling the cross shaft mid-way from its opposite ends; hollow elongated weights of deformable plastic non-rotatably secured to each end of said cross shaft by means of spherical connector members non-rotatably secured to the ends of said cross shaft and adapted to removably receive the ends of said elongated weights, each weight forming an obtuse angle with said cross shaft sufficient to clear the body of the exerciser; and clearance between said cross shaft and said hand grip to permit orbital movement of said cross shaft within said hand grip, wherein circular motion of said hand grip causes said cross bar to orbit within said hand grip eccentric to the center line of said hand grip.

6. An exercise device for improving muscle tone, said device comprising: an elongated shaft-like frame member having two spaced ends and two generally cylindrical gripping portions adjacent said ends; elongated, generally tubular hand grips journalled around said gripping portions whereby said frame member may rotate within said hand grips; each of said cylindrical gripping portions having a selected diameter; and two weighting means for eccentrically weighting said frame member; one of said weighting means being adjacent each of said spaced ends, each of said weighting means comprising an intermediate coupling element having a first coupling means for fixedly and non-rotatably coupling said element to said frame member at one of said spaced ends with said frame member extending along a first direction from said coupling element and second coupling means on said coupling element for coupling to an elongated hollow plastic receptacle having an elongated axis and an opening generally aligned with said axis, said opening having an inside diameter, said inside diameter being greater than said selected diameters whereby said receptacles can be telescoped over said gripping portions; said elongated receptacle extending along a second direction from said coupling element, the included angle between said first and second directions being greater than 90°.

7. An exercise device as deined in claim 6 including two hand grips wherein said hand grips have an outer major transverse dimension, said transverse dimension being less than said inside diameter of said receptacles.

8. An exercise device for improving muscle tone comprising: a cross shaft having two ends; protrusions on each end of said cross shaft with non-circular cross sections extending along the axis of the cross shaft; a pair of hand grips encircling said cross shaft positioned so as to maintain an exerciser's arms substantially parallel; hollow elongated members to eccentrically weight said cross shaft; and connector means comprising a housing encircling the terminal free end portion of the shaft protrusion for non-rotatably securing said elongated members to said cross shaft, said connector means having an aperture of the same non-circular cross section as said cross shaft protrusions.

9. The device of claim 8, wherein said cross shaft protrusions have wedge shaped snap lips which penetrate said aperture and secure said connector means against disassembly from said cross shaft.

10. The device of claim 9, wherein said elongated members are threadably secured to said connector means at an obtuse angle to said cross shaft.

11. The device of claim 10, wherein said elongated members have openings aligned with the longitudinal axis of said elongated members, said openings having a diameter greater than the diameter of said cross shaft or said hand grips whereby said elongated members may be telescoped over said cross shaft.

* * * * *